United States Patent [19]

Schmid

[11] Patent Number: 4,640,465

[45] Date of Patent: Feb. 3, 1987

[54] CHOPPER FOR GARDEN REFUSE OR THE LIKE

[75] Inventor: Dieter Schmid, Augsburg, Fed. Rep. of Germany

[73] Assignee: Lescha Maschinenfabrik GmbH, Fed. Rep. of Germany

[21] Appl. No.: 738,456

[22] Filed: May 28, 1985

[30] Foreign Application Priority Data

Mar. 23, 1985 [DE] Fed. Rep. of Germany ... 8508739[U]

[51] Int. Cl.[4] ..... B02C 18/22

[52] U.S. Cl. ..... 241/37.5; 241/55; 241/92; 241/101.7

[58] Field of Search ..... 241/37.5, 92, 101.7, 241/55, 56, 186.2, 186.3

[56] References Cited

U.S. PATENT DOCUMENTS 2,847,811 8/1958 Martin et al. ..... 241/101.7 X
3,014,515 12/1961 Meeker et al. ..... 241/37.5

FOREIGN PATENT DOCUMENTS 1160688 1/1964 Fed. Rep. of Germany ... 241/101.7
3118518 11/1982 Fed. Rep. of Germany ... 241/101.7

*Primary Examiner*—Mark Rosenbaum
*Attorney, Agent, or Firm*—Watts, Hoffmann, Fisher & Heinke Co.

[57] ABSTRACT

In the case of a chopper for garden refuse or the like comprising a knife disk or rotor in a housing with an inlet passage mounted on it and an ejection passage running out from it, it is possible to ensure both effective protection against injury by contact with the rotor and also a freedom from blockages by designing the ejection passage so that it firstly increases and then decreases in cross section.

17 Claims, 2 Drawing Figures

CHOPPER FOR GARDEN REFUSE OR THE LIKE

BACKGROUND OF THE INVENTION

The present invention relates to choppers for garden refuse or the like comprising a driven knife disk mounted in a housing on which a charging hopper is mounted so that its axis is at an angle to the cutting plane of the knife, the housing further having an extension running generally radially in relation to the axis of the knife disk and forming the wall of an ejection passage.

An important consideration in the design of choppers of this type is that the knife disk is not to be directly accessible from the outside and more particularly cannot be reached by putting one's hand in through the ejection passage. In some designs of such choppers as so far proposed the ejection passage has had a comparatively large inner cross section remaining constant along its length. To make the disk inaccessible from the outside it is accordingly sufficient to divide up the ejection passage into a number of separate passage sections by having a number of partitions running in its length direction. The manufacturer may then be certain that the user will not be able to put his or her hand into the ejection passage. However there is then a chance of chopped material collecting on the upstream edges of such partitions and after the chopper has been running for a longish time there will be such a build-up of material that the machine will no longer function.

Therefore designs have been attempted omitting the partitions and with such a narrow form of ejection passage that it is not longer possible to reach into it. Such a construction then however involves a risk of blockages.

SHORT SUMMARY OF THE INVENTION

Accordingly one object of the present invention is to modify the design of a chopper of the short mentioned initially such that there is no chance of the user being able to reach into the outlet passage without such design modification making the chopper prone to blockages.

In order to attain this or other objects, in the invention the inner cross section of the ejection passage normal to the direction of ejection firstly increases in a direction away from the knife disk and then decreases.

This design is advantageous inasfar as that it is possible to have such a constriction at the end of the ejection passage such that the user is not able to put his hand into it from the outside while at the same time the widening out of the cross section of the ejection passage at its upstream end allows the air current, as impelled by the knife disk and laden with choppings, to expand in the widening section of the ejection passage and there is no violent air flow which might, if it existed, lead to the build-up of deposits on edges of structures against which the air current impinges. Tests have proved that with the combination of features in accordance with the invention no trouble is to be expected with stoppages even despite the access-defeating design.

In accordance with a convenient further development of the invention the desired reduction in the internal cross section of the ejection passage may be caused by having a variation in the internal width of the ejection passage. The internal breadth of the ejection passage may in this case be generally constant all along its length, something that offers manufacturing advantages.

As part of a further convenient feature of the invention the ejection passage may be fashioned in two sections that are joined together at the transverse plane thereof where the passage has its maximum cross section, the section that is downstream being designed as a preferably detachable short pipe formed on the housing associated with the knife disk. This part of the design amounts to a simple way of facilitating servicing since the said short pipe may be taken off for such a purpose. Furthermore, the sectional construction provides a simple way of guiding the ejection current inasfar as it is possible for the longitudinal axis of the downstream passage section (or spout) to be inclined in relation to the longitudinal axis of the upstream section of the ejection passage as may be desired.

In keeping with a further advantageous development of the invention, it is possible for the ejection passage to have at least one opening in the wall where it has its greatest cross section. This makes it possible for air to escape from the ejection passage where its cross section is greatest and therefore to enhance the desired expansion of the air.

Further convenient forms and useful outgrowths of the invention will appear in the course of the following description of one embodiment thereof with reference to the drawings and to the claims.

LIST OF THE DIFFERENT VIEWS OF THE FIGURES

DETAILED ACCOUNT OF WORKING EXAMPLE OF THE INVENTION

Figure 1:
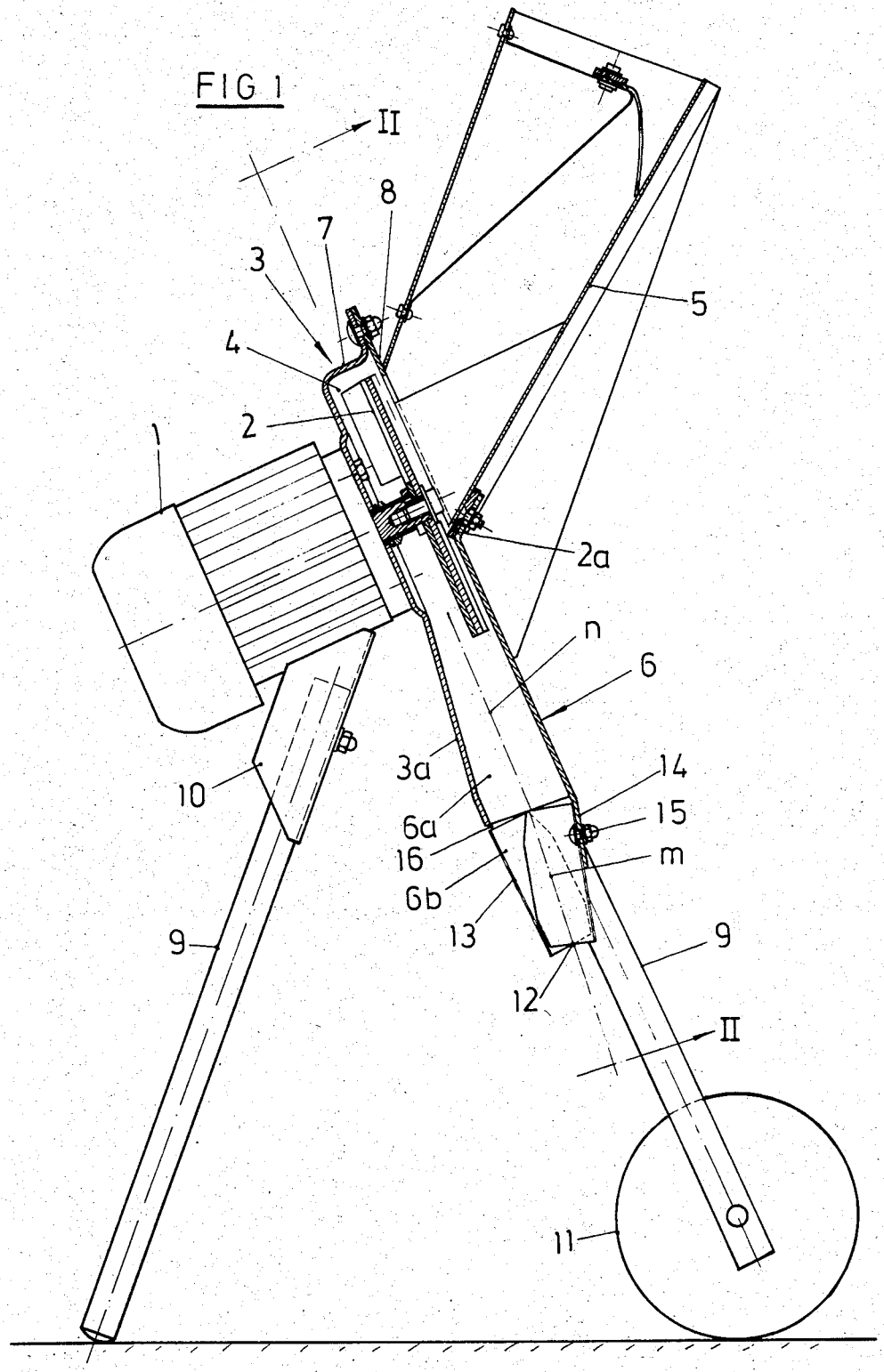
FIG. 1 is a side view of a garden refuse chopper in accordance with the invention, partly in section.
Figure 2:
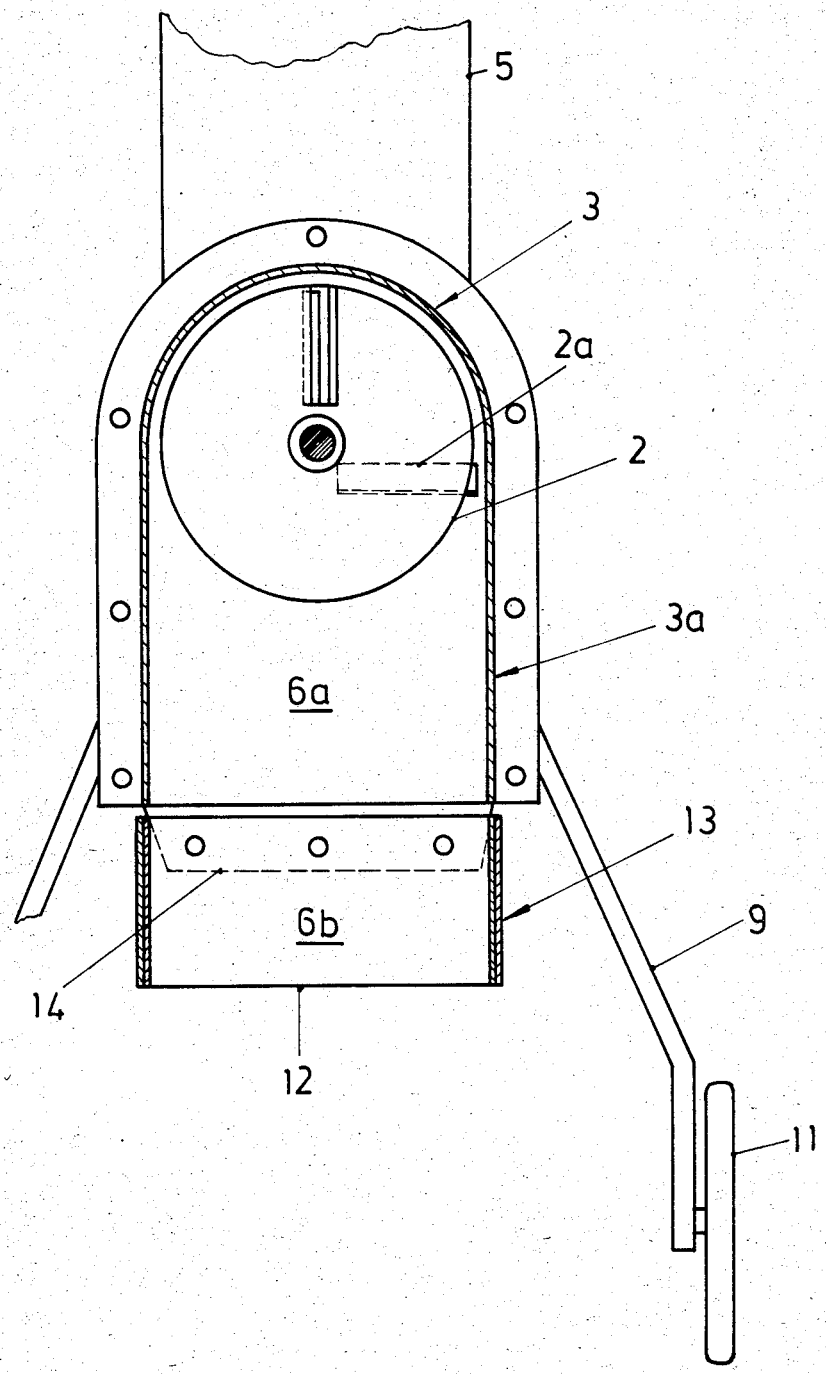
FIG. 2 is a section taken on the line II/II of FIG. 1.

The chopper to be seen in the drawings comprises a knife disk 2 or cutting rotor and impeller which is mounted on the stub shaft of an electric motor 1 and is located in a chamber 4 within a housing 3. The knife or knives of the knife bearing disk 2 cooperate with a stationary knife 2*a*. The design and workings of such a cutting or chopping device are known and therefore not in need of any detailed description at this juncture. The housing 3 with the chamber 4 therein is formed with an inlet port parallel to the plane of the knife disk 2 and with an ejection port placed at its periphery. An inlet or charging passage 5 is placed over the inlet cross section so that the axis of this passage stands at an angle to the plane of the knife disk 2. At the ejection port the chamber 4, in which the knife disk 2 is located, merges into a downwardly directed ejection passage 6 that is radial in relation to the axis of the disk 2 and in the present instance is directed downwardly. This downwardly directed ejection passage 6 aligned with the direction of cutting forms a radial extension of the housing 3 with the chamber 4 therein.

The housing 3 with the chamber 4 and the ejection passage 6 therein consists in the present case of a deep-drawn dish 7 and a cover 8 that is flanged thereto and defines the inlet port. The electric motor 1 is flange-mounted on the dish 7. The inlet passage 5 placed over the inlet port is mounted on the cover 8. For supporting the housing 3 in the desired position with the plane of the knife disk at an angle to the horizontal there are three support legs 9. One of these legs 9 is screwed to a holder 10 that is attached to the electric motor 1. The two further support legs 9 are secured to the side edges of the extension of the housing 3 constituting the ejection passage 6. To make the appliance easy to move about these two support legs 9 may have ground wheels 11 at their respective lower ends.

The lower end port of the ejection passage 6 is so dimensioned that it is not possible for the user of the appliance to put his or her hand into the passage. In order nevertheless to ensure a reliable ejection of the choppings without any stoppages, the ejection passage 6 is so fashioned that its internal cross section as measured normal to the axis of the passage firstly increases in size with an increase in the distance from the knife disk 2 to then start decreasing in size towards the lower end port 12 of the passage. The part with an increasing internal cross section stretches at least along the upper half to two thirds of the length of the ejection passage 6. The part with a decreasing cross section extends accordingly along the lower half of the ejection passage and may only run along the lower third of the passage.

To facilitate the manufacture of an ejection passage, that is more of less in the form of two funnels with their wider ends joined together, it is divided where its cross section is greatest. The upper downwardly flaring section 6*a* of the ejection passage is defined by the extension 3*a* of the housing 3 extending from therefrom. The lower downwardly narrowing section 6*b* of the ejection passage is defined by a short spout 13 mounted on the extension of 3*a* of the housing. This spout 13 is fixed to a holding cleat 14 on the cover 8 running out past the lower end of the extension 3*a* of the housing. In the embodiment depicted, there are simple attachment screws 15 to secure the short pipe 13 on the associated holding cleat 14. By undoing these attachment screws 15 it is then possible to dismount the spout 13, for example for repairs or cleaning. The holding cleat 14 resting against the outer face of the wall of the spout 13 is at such an angle in relation to the plane of the cover that the axis m of the spout 13 is inclined at a small angle to the axis n of the extension 3*a* of the housing towards the back, that is to say in relation to the lower side of the knife disk 2, this ensuring that the choppings are discharged to the back as may be an advantage if a basket or other receptacle is placed to receive them under the ejection passage.

In order to facilitate manufacture of the ejection passage 6 it may however be designed with an approximately unvarying breadth along its length. The desired variation in the cross section is then only due to a change in its width. The spout 13 constituting the downwardly narrowing section 6*b* of the ejection passage 6 may then take the form of two like halves of channel cross section that are symmetrically placed with respect to a median plane and placed so that their backs converge in a downward direction in the form of a letter V and their adjacent limbs are joined together, as for example by spot welding.

The spout 13 has its top end placed adjacent to the lower end of the extension 3*a* of the housing that has the holding cleat 14 projecting beyond it. In the vicinity of the butt joint bridged over by the holding cleat 14 (which in the present case fits over the adjacent wall of the spout 13), it is possible to have the parts neatly in line with each other where the are joined. In the embodiment shown there are slots 16 at the joint running out from a median contact area. These slots 16 are to let off some of the air (as propelled by knife disk) from the ejection passage 6 where its cross section is at its greatest, this assisting in expansion of the air even further. The slots 16 are produced automatically in the illustrated example of the invention inasfar as the two channel-like parts of the spout 13, that are joined together adjacent, have their backs placed together line a letter V so that the end edges of the limbs are inclined in relation to each other like sections of a roof.

I claim:

1. A chopper for refuse comprising a housing defining a chamber, a cutting rotor mounted rotatably in said chamber for turning in a cutting plane about an axis of rotation, an inlet passage mounted on said housing so that a longitudinal axis of said inlet passage is at an angle to the cutting plane, said housing further having an ejection passage and a tubular extension running out generally radially from said axis of rotation and constituting at least part of said ejection passage, said tubular extension having a substantially unimpeded internal cross section that firstly increases and then decreases in a direction away from said rotor to impede a user from inserting his hand into the ejection passage.

2. The chopper as claimed in claim 1 wherein said ejection passage has a generally constant breadth along its length, whereas its width, measured generally at a right angle to its breadth, firstly increases and then decreases in a direction away from the said rotor.

3. The chopper as claimed in claim 1 wherein said ejection passage comprises two length sections joined together where the said cross section of the ejection passage is greatest, one of such sections, which is downstream in the direction of ejection, being in the form of a tubular spout attached to said extension.

4. The chopper as claimed in claim 3 wherein said housing comprises a cover forming one wall of said chamber with said rotor in it, said inlet passage being mounted on said cover and said cover having a cleat thereon to which said ejection passage section that is downstram in relation to said other passage section is attached, said downstream ejection passage section being in the form of a spout.

5. The chopper as claimed in claim 4 wherein said downstream ejection passage section is detachably secured to said cleat.

6. The chopper as claimed in claim 3 wherein said two ejection passage sections are so joined together that longitudinal axes thereof are at an angle to each other.

7. The chopper as claimed in claim 6 wherein said longitudinal axis of the downstream one of said two sections of said ejection passage is at an angle to the said cutting plane.

8. The chopper as claimed in claim 3 wherein said downstream section of said ejection passage is made up of two channel-section pieces of sheet metal having backs thereof converging in the manner of a letter V, whereas flanges thereof are united with the flanges of the respective other piece of sheet metal.

9. The chopper as claimed in claim 1 wherein said ejection passage has at least one opening through a wall thereof where said ejection passage has its greatest internal cross section.

10. A chopper for refuse comprising a housing defining a chamber, a cutting rotor mounted rotatably in said chamber for turning in a cutting plane about an axis of rotation, an inlet passage mounted on said housing so that a longitudinal axis of said inlet passage is at an angle to the cutting plane, said housing further having an ejection passage and an extension running out generally radially from said axis of rotation and constituting at least part of said ejection passage, said extension having an internal cross section that increases and then decreases in a direction away from the cutting rotor, said extension defining at least one opening through a wall of said extension at a region of greatest internal cross section to let air driven by the cutting rotor escape from the extension.

11. The chopper as claimed in claim 10 wherein said ejection passage has a generally constant breadth along its length, whereas its width, measured generally at a right angle to its breadth, firstly increases and then decreases in a direction away from the said rotor.

12. The chopper as claimed in claim 10 wherein said ejection passage comprises two length sections joined together where the said cross section of the ejection passage is greatest, one of such sections, which is downstream in the direction of ejection, being in the form of a tubular spout attached to said extension.

13. The chopper as claimed in claim 12 wherein said housing comprises a cover forming one wall of said chamber with said rotor in it, said inlet passage being mounted on said cover and said cover having a cleat thereon to which said ejection passage section that is downstream in relation to said other passage section is attached, said downstream ejection passage section being in the form of a spout.

14. The chopper as claimed in claim 13 wherein said downstream ejection passage section is detachably secured to said cleat.

15. The chopper as claimed in claim 12 wherein said two ejection passage sections are so joined together that longitudinal axes thereof are at an angle to each other.

16. The chopper as claimed in claim 15 wherein said longitudinal axes of the downstream one of said two sections of said ejection passage is at an angle to the said cutting plane.

17. The chopper as claimed in claim 12 wherein said downstream section of said ejection passage is made up of two channel-section pieces of sheet metal having backs thereof converging in the manner of a letter V, whereas flanges thereof are united with the flanges of the respective other piece of sheet metal.

* * * * *